United States Patent [19]

Peters

[11] 4,438,929

[45] Mar. 27, 1984

[54] DROP TARGET WITH CAM MEANS

[75] Inventor: Albin Peters, Chicago, Ill.

[73] Assignee: Wico Corporation, Niles, Ill.

[21] Appl. No.: 289,371

[22] Filed: Aug. 3, 1981

[51] Int. Cl.[3] ..... A63D 13/00

[52] U.S. Cl. ..... 273/127 R

[58] Field of Search ..... 200/61.1, 61.11; 273/127 R, 127 A, 127 C, 118 R, 118 A, 118 D, 273/119 R, 119 A, 121 R, 121 A, 121 D, 121 E, 122 A, 122 R, 123 R, 123 A, 124 R, 124 A, 125 R, 273/125 A, 384, 386

[56] References Cited

U.S. PATENT DOCUMENTS

| | | | |
|---|---|---|---|
| 4,190,252 | 2/1980 | Kindig | 273/127 R |
| 4,221,384 | 9/1980 | Krynski | 273/121 A |
| 4,257,604 | 3/1981 | Grabel et al. | 273/127 R |
| 4,260,156 | 4/1981 | Momura | 273/127 R |

*Primary Examiner*—Richard T. Stouffer

*Attorney, Agent, or Firm*—Dithmar, Stotland, Stratman & Levy

[57] ABSTRACT

A target member in a drop target assembly of a pinball game has a cam surface formed on the rear surface thereof and adapted for camming engagement with the assembly frame when the target member is deflected by a pinball and unlatched from its raised condition for positively driving the target member downwardly to prevent its rebound to its latched condition.

5 Claims, 9 Drawing Figures

DROP TARGET WITH CAM MEANS

BACKGROUND OF THE INVENTION

The present invention relates to a target device for pinball games and, in particular, to a drop target assembly.

In a typical drop target assembly a target member is vertically movable through a slot in a frame between a raised position extending well above the associated playfield board and a retracted position. The target member is coupled to a bias means which urges it toward its retracted position and which also urges it, when it is in its raised position, toward a latched condition in which a latch notch in the target member engages the frame to hold the target member in its raised position and prevent it from dropping to its retracted position. When the raised target member is struck by a pinball, it is deflected backwards a slight distance sufficient to unlatch it from the frame, whereupon it is retracted by the bias means. However, such drop target members sometimes fail to drop when engaged by a pinball, because when the target member is struck with sufficient force, it rebounds off the back of the slot in the frame and snaps immediately back to its latched condition before the bias means can pull it downwardly a sufficient distance so that the latch notch clears the top of the frame.

SUMMARY OF THE INVENTION

The present invention relates to an improved drop target assembly which avoids the disadvantages of prior assemblies while affording additional structural and operating advantages.

It is a general object of this invention to provide a drop target assembly which effectively insures that the target member will drop when it is unlatched by a pinball.

In connection with the foregoing objects, it is another object of this invention to provide a drop target assembly of the type set forth which includes means positively to drive the target member downwardly in response to the unlatching movement thereof.

It is another object of this invention to provide an improved target member for such a drop target assembly.

These and other objects of the invention are attained by providing in a drop target assembly for a pinball game which includes a frame, a target member vertically movable with respect to the frame between a raised position projecting above an associated playfield board and a retracted position, the target member, in its raised position, being movable between a latched condition engaging the frame for preventing vertical movement and a released condition permitting vertical movement, and bias means urging the target member to its retracted position and to its latched condition, the target member, when latched in its raised condition, being engageable by a rolling pinball on the playfield board for movement to its released condition, the improvement comprising: control means associated with the target member and responsive to movement thereof from the latched condition to the released condition positively to drive the target member downwardly from its raised position, thereby to prevent rebound of the target member to its latched condition.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

DESCRIPTION OF THE PREFERRED EMBODIMENT

Figure 2:
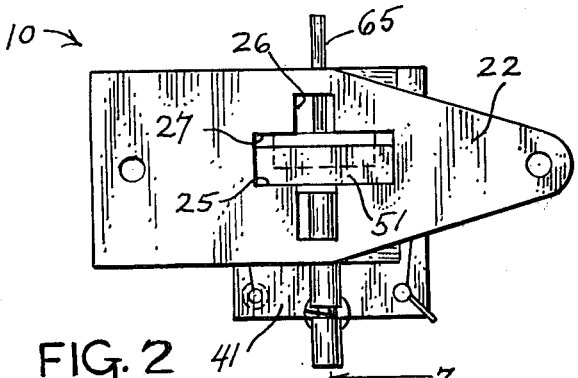
FIG. 2 is a top plan view of the target assembly of FIG. 1.

Referring now more particularly to the drawings, there is illustrated a drop target assembly, generally designated by the numeral 10, constructed in accordance with and embodying the features of the present invention. The drop target assembly 10 is adapted for mounting beneath a playfield board 11 of a pinball game. More particularly, the playfield board 11 has a flat, horizontal upper surface 12 and a lower surface 13 and is provided with a rectangular slot 14 extending vertically therethrough for a purpose to be explained more fully below. In use, a pinball 15 is propelled along the upper surface 12 of the playfield board 11 for rolling engagement with one or more targets in a well-known manner.

The drop target assembly 10 includes a frame, generally designated by the numeral 20, which may be formed of plastic and be of molded one-piece construction, the frame 20 including an upstanding post 21 and provided at the upper end thereof with a guide arm 22 extending therefrom substantially normal thereto. The guide arm 22 has a flat, upper surface 23 which, in use, is disposed against the lower surface 13 of the playfield board 11 and is fixedly secured thereto by suitable fasteners (not shown). The post 21 has an elongated vertical actuator slot 24 formed therethrough, and the guide arm 22 has formed therethrough two rectangular target slots 25 and 26 which intersect substantially at right angles to each other. The target slot 25 has a rear edge surface 27 and is arranged in registry with the slot 14 in the playfield board 11, the slot 14 being wider than the target slot 25. Interconnecting the post 21 and the guide arm 22 along adjacent edges thereof is a vertical guide flange 28 provided with a vertical guide slot 29 therein which is open at the lower end thereof.

Mounted on the rear surface of the post 21 is a switch assembly, generally designated by the numeral 30, which includes a fixed contact 31, a movable contact 32, and a leaf spring 33 resiliently biasing the movable contact 32 away from the fixed contact 31. Engageable with the movable contact 32 is an actuator spring 35 which is normally disposed in engagement with the rear surface of the post 21 and is deflectable in a manner to be described below, for moving the movable contact 32 into engagement with the fixed contact 31.

Mounted on the front surface of the post 21 is a reset assembly, generally designated by the numeral 40, which includes a mounting bracket 41 fixedly secured to the post 21 and carrying thereon a solenoid coil 42 which is provided with an elongated solenoid plunger 43 extending vertically coaxially therethrough. The plunger 43 is provided at its upper end with a pivot pin 45 and with stop flanges for limiting the downward movement of the plunger 43.

Figure 1:
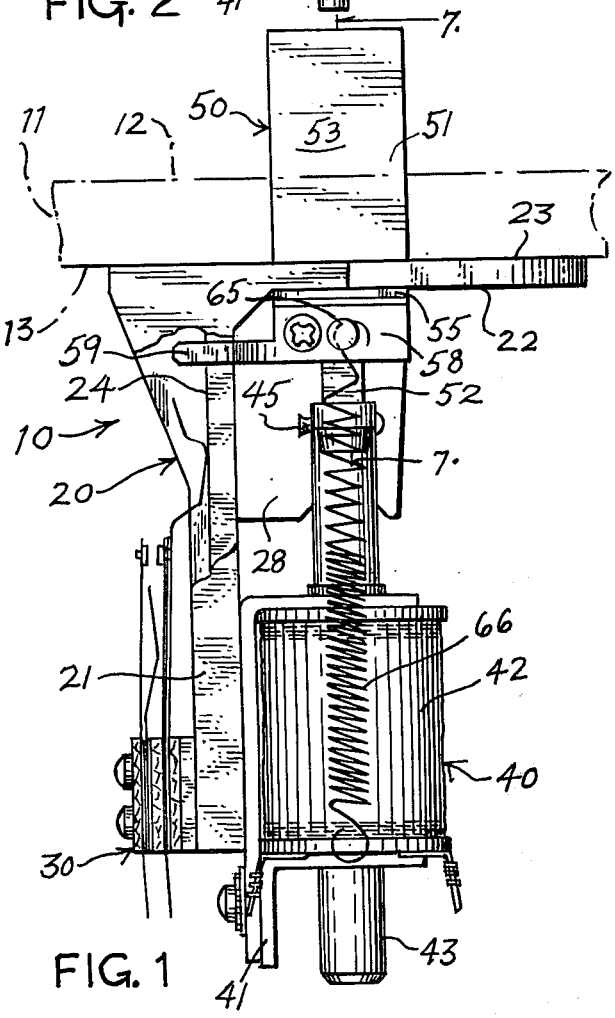
FIG. 1 is a side elevational view of a drop target assembly constructed in accordance with and embodying the features of the present invention, with the target member shown latched in its raised position.

Coupled to the plunger 43 is a target member, generally designated by the numeral 50, which includes an elongated flat, rectangular body 51, which may be molded of plastic, the body 51 being disposed vertically in use and being provided at the lower end thereof with a depending coupling tongue 52 which is disposable in the upper end of the solenoid plunger 43 and is pivotally coupled thereto by means of the pivot pin 45. The body 51 has flat, planar parallel front and rear surfaces 53 and 54, the body 51 being oriented and dimensioned to extend vertically upwardly through the target slot 25 in the guide arm 22 and through the slot 14 in the playfield board 11, with the rear surface 54 of the body 51 facing the rear edge surface 27 of the target slot 25. Formed in the front surface 53 of the body 51 adjacent to the lower end thereof is a latch notch 55 extending horizontally laterally across the body 51 and being generally C-shaped in transverse cross section, the upper edge of the latch notch 55 forming a rectangular latch surface 56. The upper portion of the body 51 may have a rectangular lightening recess 57 formed in the rear surface 54 thereof. Fixedly secured to the front surface 53 of the body 51 immediately beneath the latch notch 55 is a switch plate 58 provided with an elongated actuator arm 59 which extends rearwardly through the actuator slot 24 in the post 21 (see FIGS. 1, 4 and 5).

The body 51 is also provided with a downwardly inclined cam surface 60 extending outwardly from the rear surface 54 transversely opposite the latch notch 55. The cam surface 60 terminates in a short vertical surface 61, the lower edge of which is connected to the rear surface 54 by a short horizontal surface 62. The upper edge of the cam surface 60 is continuous with an arcuate cam groove 63 formed in the rear surface 54. An elongated pin 65 extends through complementary bores in the coupling tongue 52 and the switch plate 58 immediately beneath the horizontal surface 62, one end of the pin 65 being coupled to the upper end of a helical tension spring 66, the lower end of which is anchored to the bracket 41.

Figure 4:
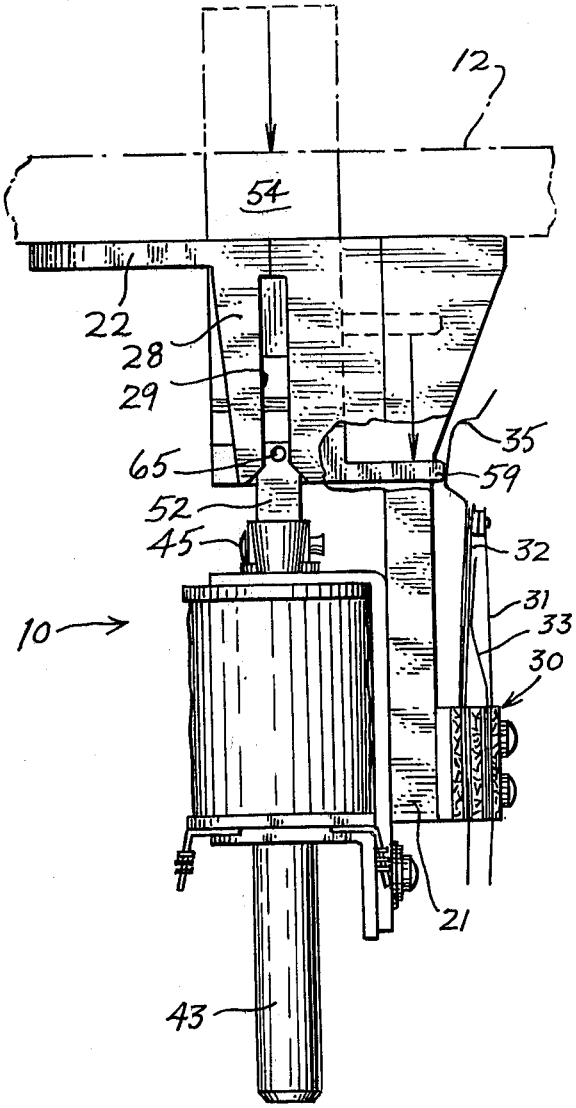
FIG. 4 is a side elevational view of the target assembly of FIG. 1 as viewed from the opposite side thereof, with the target member shown in its retracted position.
Figure 3:
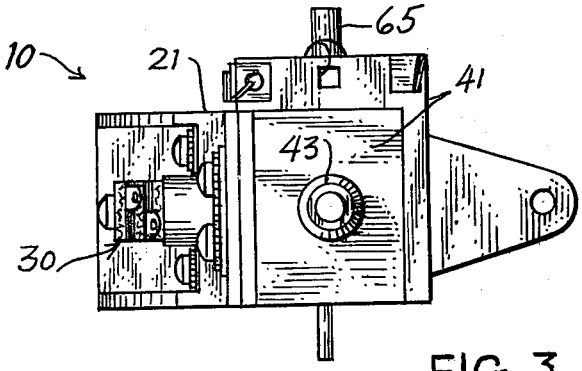
FIG. 3 is a bottom plan view of the target assembly of FIG. 1.
Figure 5:
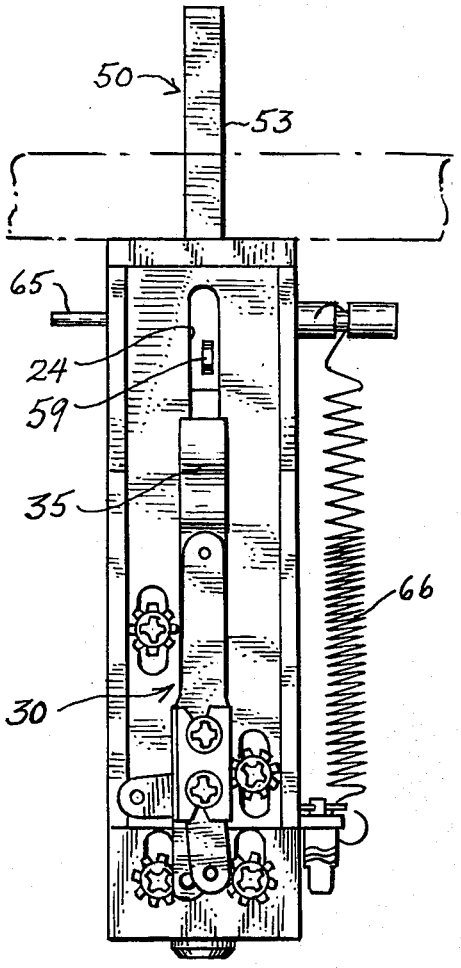
FIG. 5 is an end elevational view of the target assembly of FIG. 1 as viewed from the left-hand end thereof.
Figure 6:
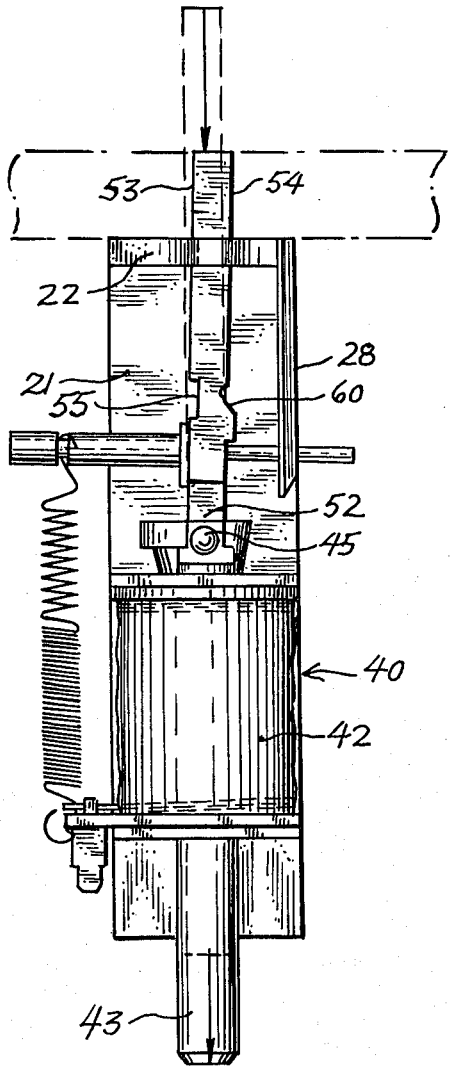
FIG. 6 is an end elevational view of the target assembly of FIG. 1 as viewed from the right-hand end thereof, with the target member shown in its retracted position.

In use, it will be appreciated that the target member 50 is vertically movable through the target slot 25 and the slot 14 between a raised or fully extended position illustrated in FIGS. 1, 2, 5 and 7, and a retracted or fully lowered position illustrated in FIGS. 4 and 6. The spring 66 provides a bias which urges the target member 50 towards its retracted position. Furthermore, when it is in its raised position, the target member 50 is pivotally movable about the axis of the pivot pin 45 between a latched condition, illustrated in FIGS. 1, 2, 5 and 7, and a released condition illustrated in FIG. 8. When the target member 50 is in its latched condition, the portion of the guide arm 22 along the forward edge of the target slot 25 is received in the latch notch 55 so that the latch surface 56 engages the upper surface 23 of the guide arm 22, thereby effectively to hold the target member 50 in its raised position and prevent it from being retracted, this latching action being accommodated by the fact that the slot 14 in the playfield board 11 is wider than the target slot 25. In its released condition, the target member 50 is moved back against the rear edge surface 27 of the target slot 25, so that the latch surface 56 is out of engagement with the guide arm 22, thereby to permit the target member 50 to be retracted under the urging of the spring 66.

It will be appreciated that the point at which the spring 66 engages the pin 65 is spaced from the target member 50 a distance such that the spring 66 exerts on the target member 50 not only a downward bias but also a forward bias so as to resiliently urged the target member 50 toward its latched condition. Thus, whenever the target member 50 is moved to its raised position, it will automatically latch under the urging of the spring 66.

The solenoid coil 42 is adapted to be connected to a suitable source of electric power through the contacts of the switch assembly 30. When the target member 50 is in its raised position, the switch contacts 31 and 32 are open, as illustrated in FIG. 2, thereby de-energizing the solenoid coil 42 so that when the target member 50 is unlatched, it can readily be pulled to its retracted position by the spring 66, the pin 65 being guided in the slot 29. When the target member 50 moves to its retracted position, the actuator arm 59 engages the actuator spring 35 for closing the contacts of the switch assembly 30, thereby to energize the solenoid coil 42. Upon energization, the solenoid plunger 43 is moved upwardly for resetting the target member 50 in its raised position. It will be understood that the closure of the contacts of the switch assembly 30 may also serve to energize associated circuitry such as for activating display and/or scoring devices.

Figure 7:
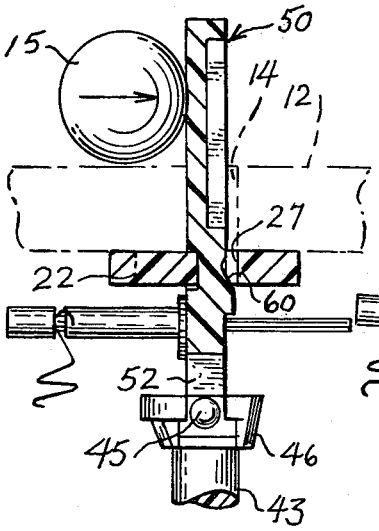
FIG. 7 is a fragmentary view in vertical section taken along the line 7—7 in FIG. 1.
Figure 8:
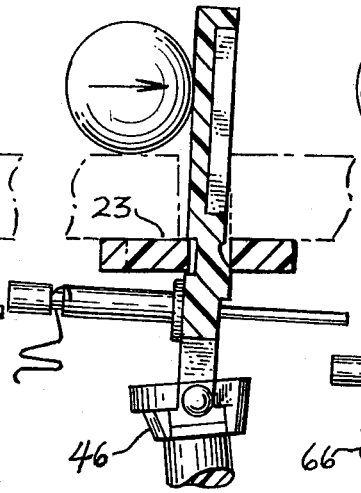
FIG. 8 is a view similar to FIG. 7 and illustrating the target member in its released condition after being unlatched by a pinball.
Figure 9:
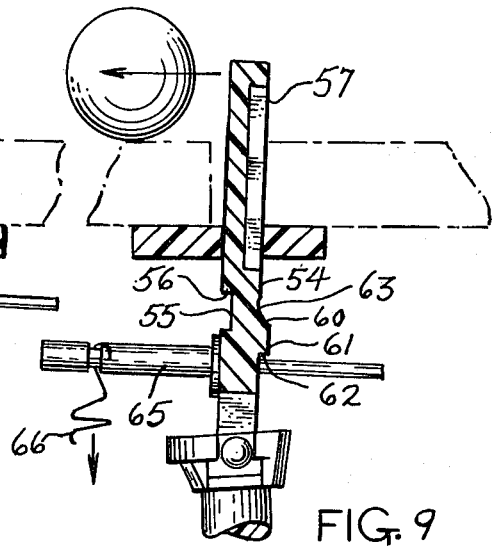
FIG. 9 is a view similar to FIG. 7 and illustrating the target member partially retracted.

In normal operation, when the target member 50 is in its raised position, it extends well above the upper surface 12 of the playfield board 11, as illustrated for example in FIG. 7. When the raised target member 50 is engaged by a pinball 15, it is tilted back from its latched condition to its released condition, as illustrated in FIG. 8. It is a significant feature of the present invention that as the target member 50 moves from its latched condition to its released condition, the inclined cam surface 60 is brought into camming engagement with the rear edge surface 27, thereby to cam the target member 50 downwardly a slight distance sufficient to move the latch surface 56 just below the level of the upper surface 23 of the guide arm 22, as best illustrated in FIG. 8. Thus, even if the target member 50 rebounds off the rear edge surface 27, it cannot return to its latched condition. This insures that once the target member 50 is unlatched, it will be pulled to its retracted position by the spring 66, as indicated in FIG. 9. In this regard, it will be noted that the cam groove 63 serves to provide an extension for the upper end of the inclined cam surface 60, thereby to maximize the extent of the downward camming movement which will be undergone by the target member 50 as it is moved to its released condition.

It will be appreciated that the target slot 26 permits an alternate orientation of the target member 50, rotated about its axis 90° from the orientation illustrated in the drawings.

From the foregoing, it can be seen that there has been provided an improved drop target assembly for a pinball game which effectively prevents the target member from rebounding and relatching itself in its raised position, thereby to insure retraction of the target member when it is engaged by a pinball.

I claim:

1. In a drop target assembly for a pinball game which includes a frame, a target member vertically movable with respect to the frame between a raised position projecting above an associated playfield board and a retracted position, the target member in its raised position being movable between a latched condition engaging the frame for preventing vertical movement and a released condition permitting vertical movement, and bias means urging the target member to its retracted position and to its latched condition, the target member when latched in its raised position being engageable by a rolling pinball on the playfield board for movement to its released condition, the improvement comprising: a cam follower edge on the frame, a cam surface associated with the target member and so positioned that when the target member is disposed in the latched condition thereof said cam surface is intersected by a plane passing through said cam follower edge parallel to the playfield board, said cam surface being responsive to movement of the target member from the latched condition to the released condition for camming engagement with said cam follower edge positively to drive the target member downwardly from its raised position, thereby to prevent rebound of the target member to its latched condition.

2. The drop target assembly of claim 1, wherein the target member has front and rear surfaces, said cam surface being disposed adjacent to the lower end of the target member and inclined downwardly and outwardly from the rear surface.

3. The drop target assembly of claim 2, and further including a recessed portion formed in the rear surface of the target member and continuous with said cam surface.

4. A drop target for a pinball game comprising an elongated target body having front and rear surfaces, a rectangular notch formed in said front surface closely adjacent to one end thereof and extending laterally thereacross, said notch having an inner surface disposed substantially parallel to the direction of elongation of said target body, and a cam surface extending outwardly from said rear surface adjacent to said one end of said body and inclined with respect to said inner surface of said notch, said cam surface being intersected by a plane disposed normal to the direction of elongation of said target body and intersecting said notch.

5. The drop target of claim 4, wherein said cam surface is inclined outwardly toward said one end of said body.

* * * * *